US009343802B2

(12) United States Patent
Su et al.

(10) Patent No.: US 9,343,802 B2
(45) Date of Patent: May 17, 2016

(54) COMMUNICATION DEVICE AND ANTENNA THEREOF

(71) Applicant: KING SLIDE TECHNOLOGY CO., LTD., Kaohsiung (TW)

(72) Inventors: Hsin-Cheng Su, Kaohsiung (TW); Chun-Ta Liu, Kaohsiung (TW); Shu-Chen Lin, Kaohsiung (TW)

(73) Assignee: KING SLIDE TECHNOLOGY CO., LTD., Kaohsiung Science Park, Lu Zhu Dist., Kaohsiung (TW)

( * ) Notice: Subject to any disclaimer, the term of this patent is extended or adjusted under 35 U.S.C. 154(b) by 98 days.

(21) Appl. No.: 14/515,494

(22) Filed: Oct. 15, 2014

(65) Prior Publication Data

US 2016/0111771 A1 Apr. 21, 2016

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243
See application file for complete search history.

(56) References Cited

U.S. PATENT DOCUMENTS 7,678,569 B2 * 3/2010 Bukh ..... A61K 39/29 435/235.1
8,688,176 B2 * 4/2014 Mareno ..... H04M 1/026 361/807
9,203,141 B1 * 12/2015 Su ..... H01Q 1/243 343/702
2004/0257283 A1 * 12/2004 Asano ..... H01Q 1/243 343/702
2007/0030204 A1 * 2/2007 Heng ..... H01Q 1/22 343/702
2011/0304223 A1 * 12/2011 Togashi ..... H01Q 1/243 307/116
2012/0044114 A1 * 2/2012 Eom ..... H01Q 1/243 343/702
2013/0135158 A1 5/2013 Faraone
2014/0087674 A1 3/2014 Teng
2014/0132457 A1 5/2014 Galeev
2015/0109170 A1 * 4/2015 Kang ..... G06F 1/182 343/702

* cited by examiner

*Primary Examiner* — Trinh Dinh

(74) *Attorney, Agent, or Firm* — Winston Hsu; Scott Margo

(57) ABSTRACT

An antenna of a communication device includes a metal frame, a metal back cover and a printed circuit board. The printed circuit board includes a first circuit block and a second circuit block electrically connected to the first circuit block. A first conductor is connected between a first part of the metal frame and a signal terminal of the first circuit block. A second conductor is connected between a second part of the metal frame and a ground terminal of the first circuit block. A third conductor is connected to a third part of the metal frame. A fourth conductor is connected to a ground terminal of the second circuit block, and at least one coupling gap is defined between the third conductor and the fourth conductor. A signal terminal of the second circuit block is electrically connected to a fourth part of the metal frame.

5 Claims, 10 Drawing Sheets

COMMUNICATION DEVICE AND ANTENNA THEREOF

BACKGROUND OF THE INVENTION

1. Field of the Invention

The present invention relates to an antenna of a communication device, and more particularly, to a metal frame being utilized as a common antenna of a communication device, for emitting and receiving radio signals of the communication device.

2. Description of the Prior Art

During product development processes of conventional communication devices, such as mobile communication products, plastic housings are mainly used by manufacturers due to cost concerns, in order to maintain basic radiation characteristics of an antenna. However, a trend of metal housing is currently brought by Apple iPhones and Macbooks. Since the metal housing has light weight, good heat dissipation, high strength, high impact resistance, good looking, anti-electromagnetic and recyclable characteristics, the metal housing is getting more and more popular. Therefore, the metal housings are mainly used in development of new generations of the mobile communication products. For example, U.S. Pat. No. 8,054,231 B2 disclosed by Ahn et al. teaches a metal case having a slot, which can be used as a slot antenna of a mobile device. But the slot may obviously ruin appearance of the metal case, and the slot needs to be arranged at a position corresponding to a specific area of the metal case. The Apple iPhone cell phone from 4 series to 5 series utilizes some of metal structural components of the cell phone as a part of an antenna for radiation. Antenna design using the metal structural components can reduce size for being arranged in a limited space. The iPhone 4 has a metal loop antenna, and the iPhone 5 has a dynamic metal loop antenna. Both of them have slits formed on the metal loop antennas, as such, antenna performance can be improved, but appearance is ruined as well.

Therefore, it is important to design a proper antenna to allow electromagnetic waves to penetrate the metal case for achieving communication purposes without obviously ruining the appearance of the metal structural components.

SUMMARY OF THE INVENTION

The present invention relates to an antenna of a communication device, and more particularly, to an antenna of a communication device assembled by metal structural components without ruining appearance.

According to an embodiment of the present invention, a communication device comprises a metal frame defining an opening, the metal frame having a first part, a second part located at a position different from a position of the first part, a third part, and a fourth part located at a position different from a position of the third part; a display module; a display panel installed between the display module and the metal frame, and corresponding to the opening of the metal frame; a metal back cover; a printed circuit board, comprising a first circuit block and a second circuit block electrically connected to the first circuit block, each of the first and second circuit blocks comprising a signal terminal and a ground terminal, wherein the ground terminal contacts the metal back cover; a main body located between the metal frame and the metal back cover, the main body being made of a non-conductive material; a first conductor connected between the first part of the metal frame and the signal terminal of the first circuit block of the print circuit board; a second conductor connected between the second part of the metal frame and the ground terminal of the first circuit block of the print circuit board; a third conductor connected to the third part of the metal frame; and a fourth conductor connected to the ground terminal of the second circuit block of the print circuit board, at least one coupling gap being defined between the third conductor and the fourth conductor; wherein the signal terminal of the second circuit block of the printed circuit board is electrically connected to the fourth part of the metal frame.

Preferably, the first part and the second part of the metal frame are located closely to an upper right position of the display panel.

Preferably, the third part and the fourth part of the metal frame are located closely to a lower right position of the display panel.

According to an embodiment of the present invention, an antenna of a communication device comprises a metal frame defining an opening, the metal frame having a first part, a second part, a third part, and a fourth part; a metal back cover; a printed circuit board, comprising a first circuit block and a second circuit block electrically connected to the first circuit block, each of the first and second circuit blocks comprising a signal terminal and a ground terminal, wherein the ground terminal contacts the metal back cover; a first conductor connected between the first part of the metal frame and the signal terminal of the first circuit block of the print circuit board; a second conductor connected between the second part of the metal frame and the ground terminal of the first circuit block of the print circuit board; a third conductor connected to the third part of the metal frame; and a fourth conductor connected to the ground terminal of the second circuit block of the print circuit board, at least one coupling gap being defined between the third conductor and the fourth conductor; wherein the signal terminal of the second circuit block of the printed circuit board is electrically connected to the fourth part of the metal frame, and is coupled to the ground terminal of the second circuit block of the printed circuit board through the at least one coupling gap.

Preferably, the third conductor is extended a length to be close to the second circuit block of the printed circuit board.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
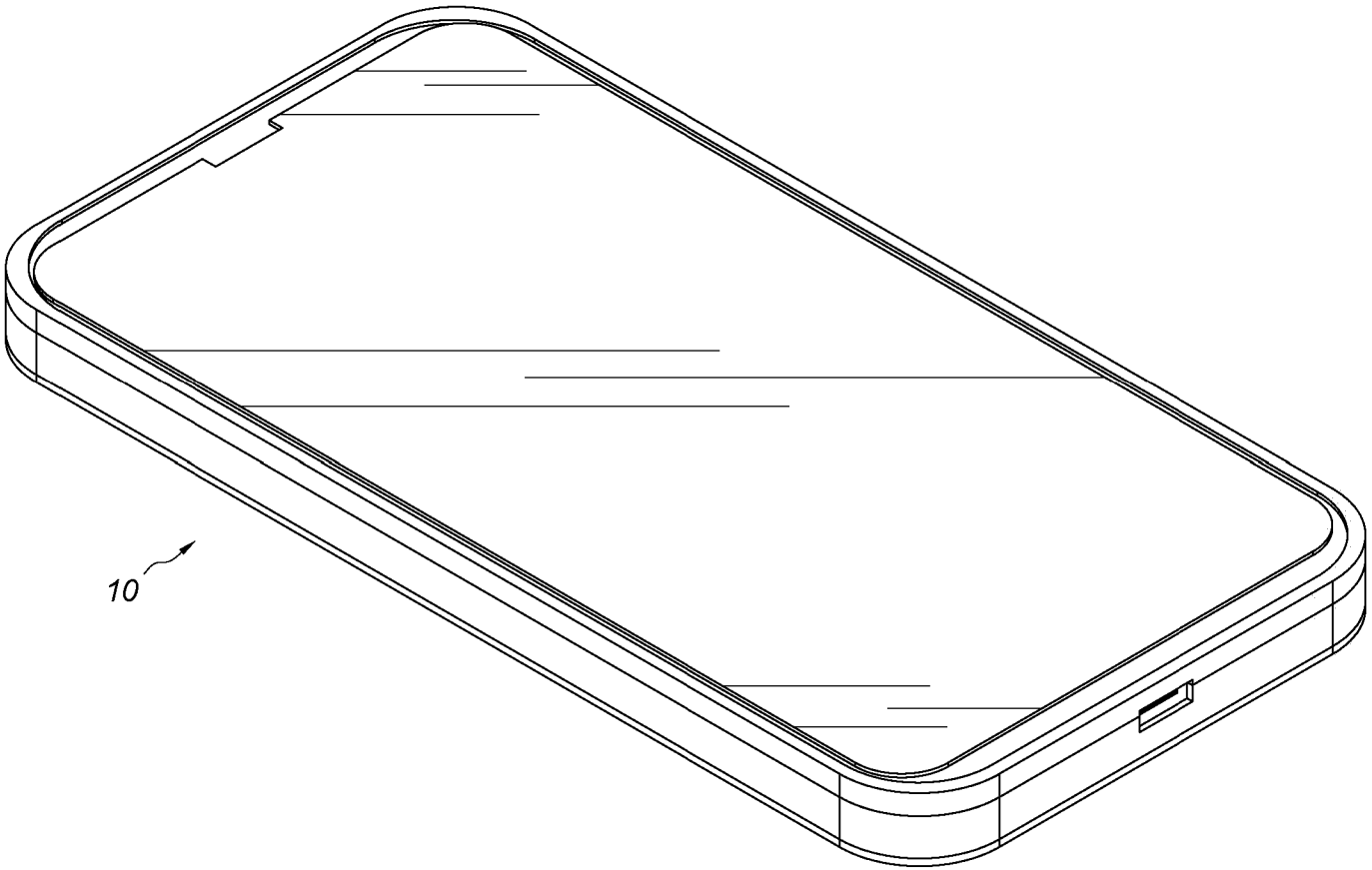
FIG. 1 is a diagram showing a communication device according to an embodiment of the present invention.
Figure 2:
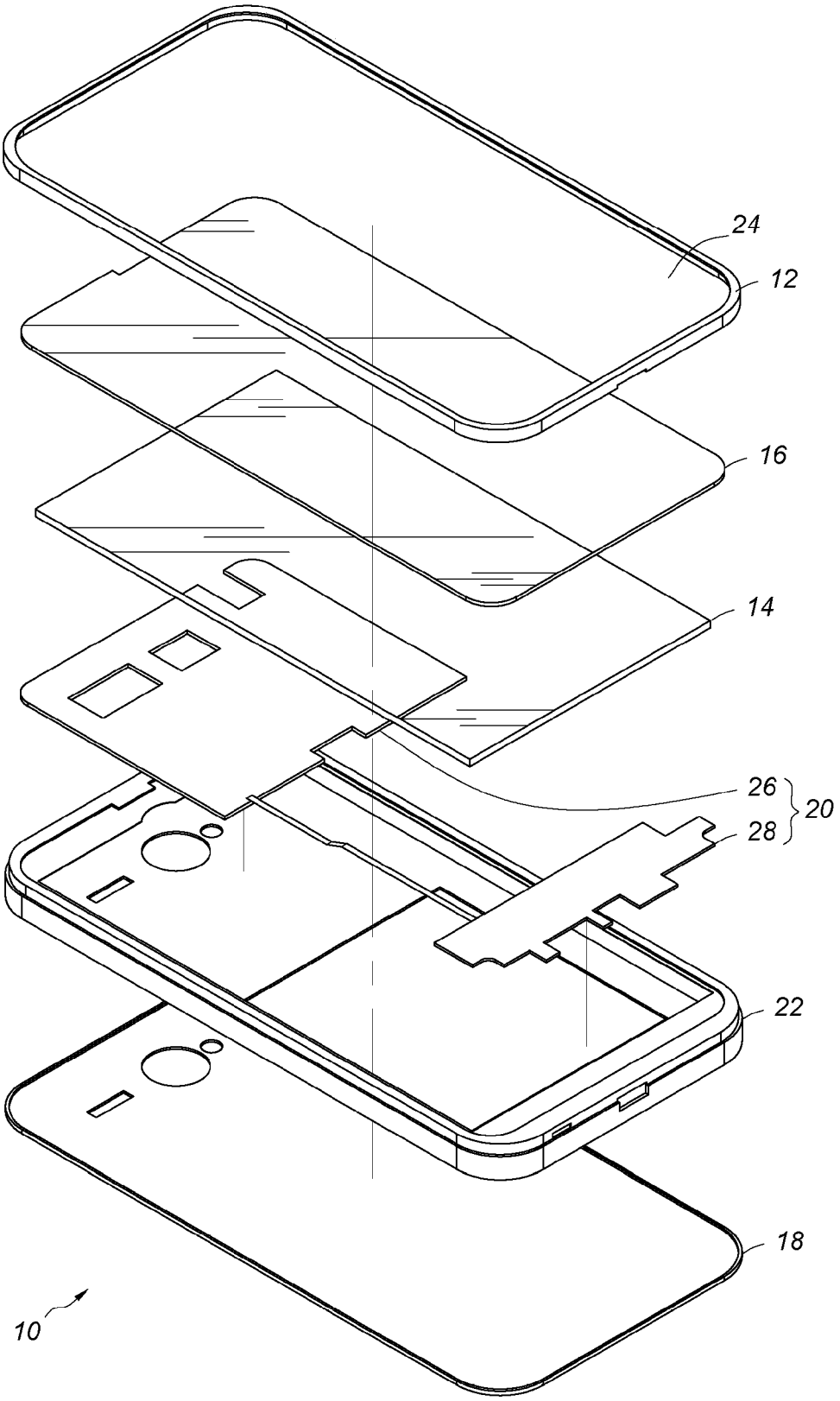
FIG. 2 is an exploded view of the communication device according to the embodiment of the present invention.

FIG. 1 and FIG. 2 are diagrams showing a communication device according to an embodiment of the present invention. The communication device 10 comprises a metal frame 12, a display module 14, a display panel 16, a metal back cover 18, a printed circuited board 20, and a main body 22. The metal frame 12 substantially is a rectangular frame defining an opening 24, and can be utilized as a front cover of the communication device 10. The display module 14 and the display panel 16 can be separated from each other or integrated together, but the present invention is not limited to the above structure. The display panel 16 is installed between the display module 14 and the metal frame 12, and corresponding to the opening 24 of the metal frame 12. The display panel 16 is made of glass, but not limited to it. The metal back cover 18 is substantially rectangular and located at a position corresponding to a bottom of the main body 22, for being utilized as a rear cover of the communication device 10. The printed circuit board 20 is located between the metal frame 12 and the metal back cover 18. The printed circuit board 20 comprises a first circuit block 26 and a second circuit block 28 electrically connected to the first circuit block 26. The main body 22 is located between the metal frame 12 and the metal back cover 18, for installing the display module 14, the display panel 16 and the printed circuited board 20 on the main body 22. In addition, the main body 22 is made of a non-conductive material, such as a plastic material, but not limited to it.

Figure 3:
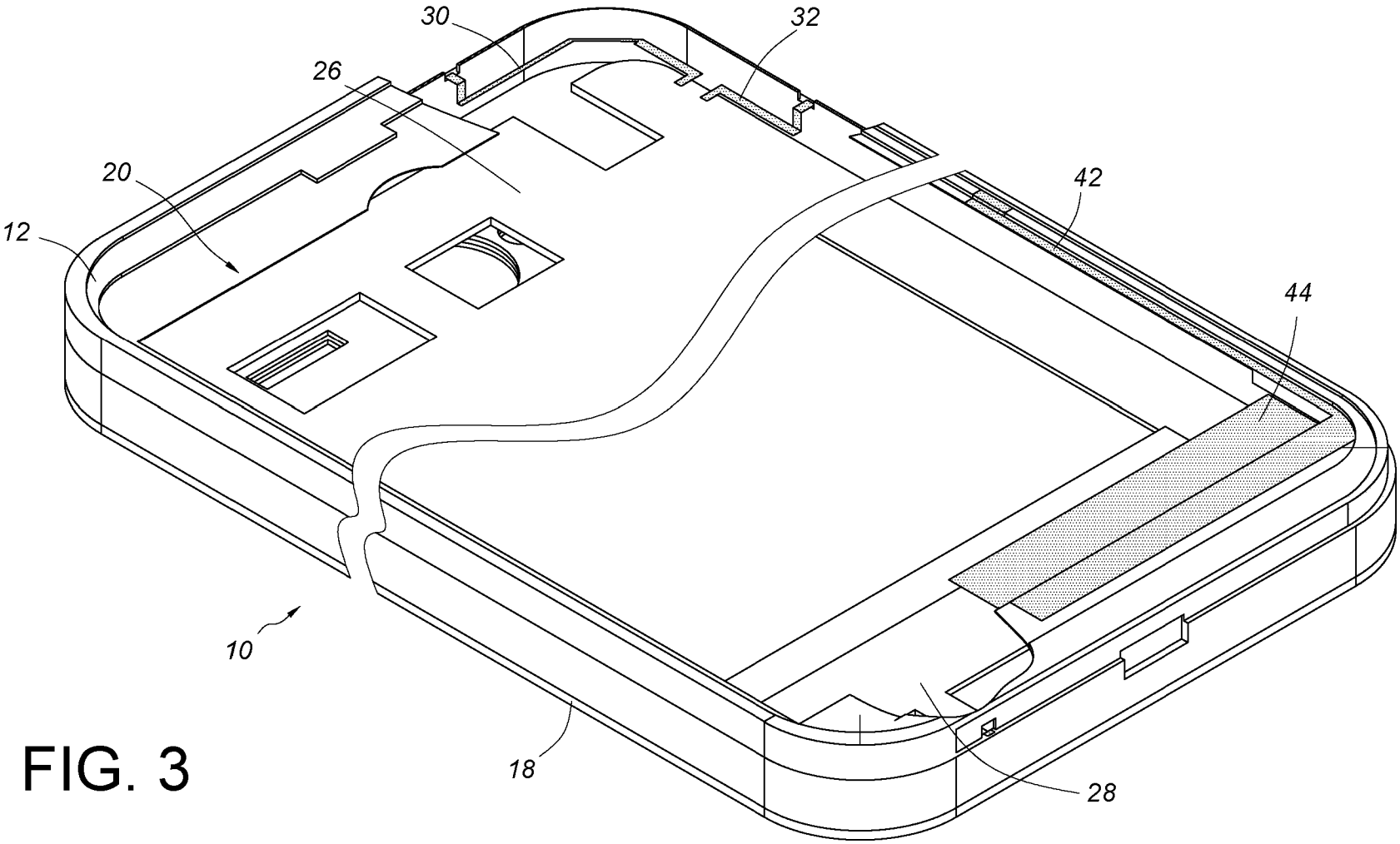
FIG. 3 is a diagram showing arrangement of an antenna of the communication device according to an embodiment of the present invention.
Figure 4:
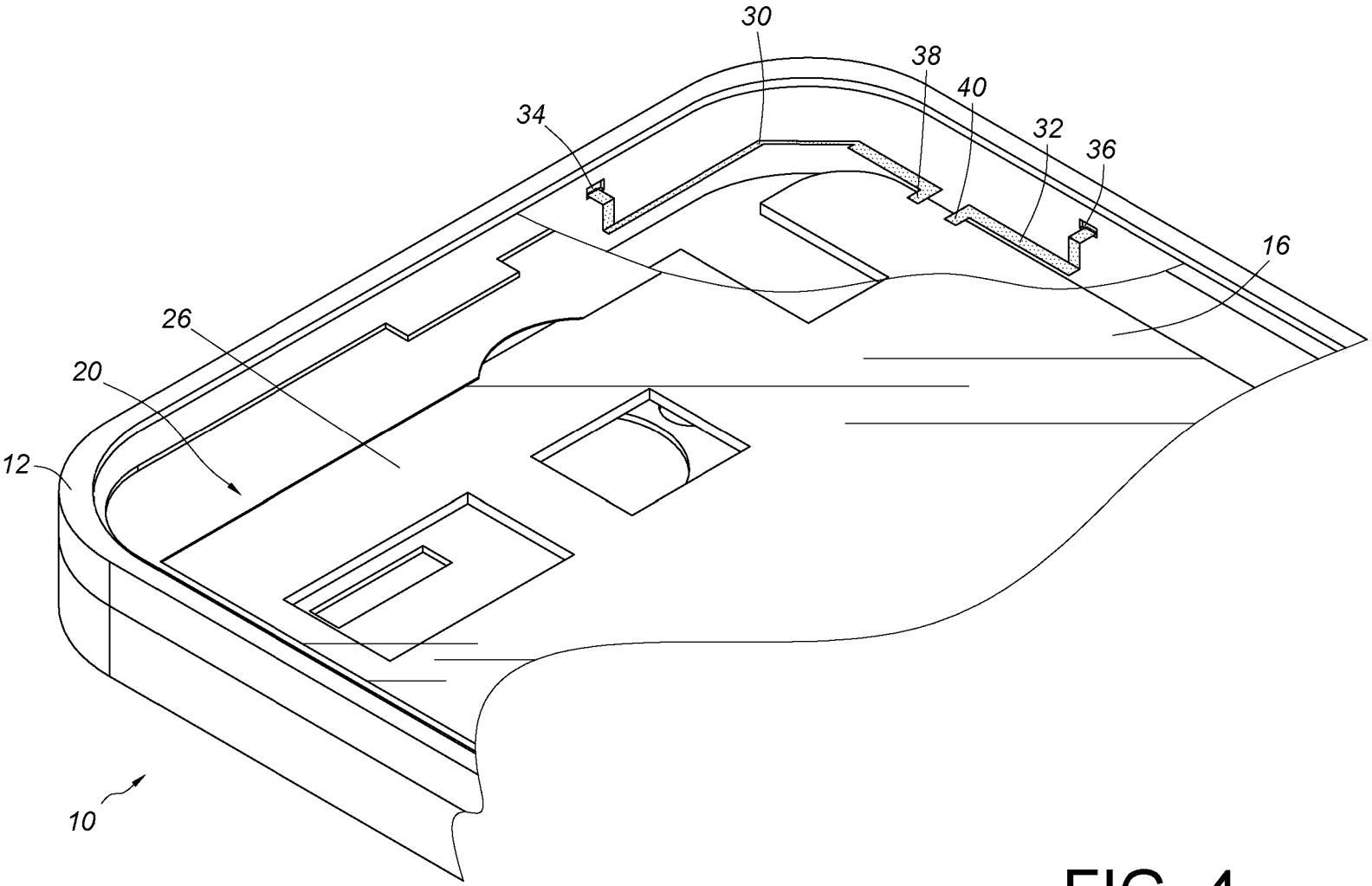
FIG. 4 is a diagram showing arrangement of the antenna at a first position of the communication device according to an embodiment of the present invention.
Figure 5:
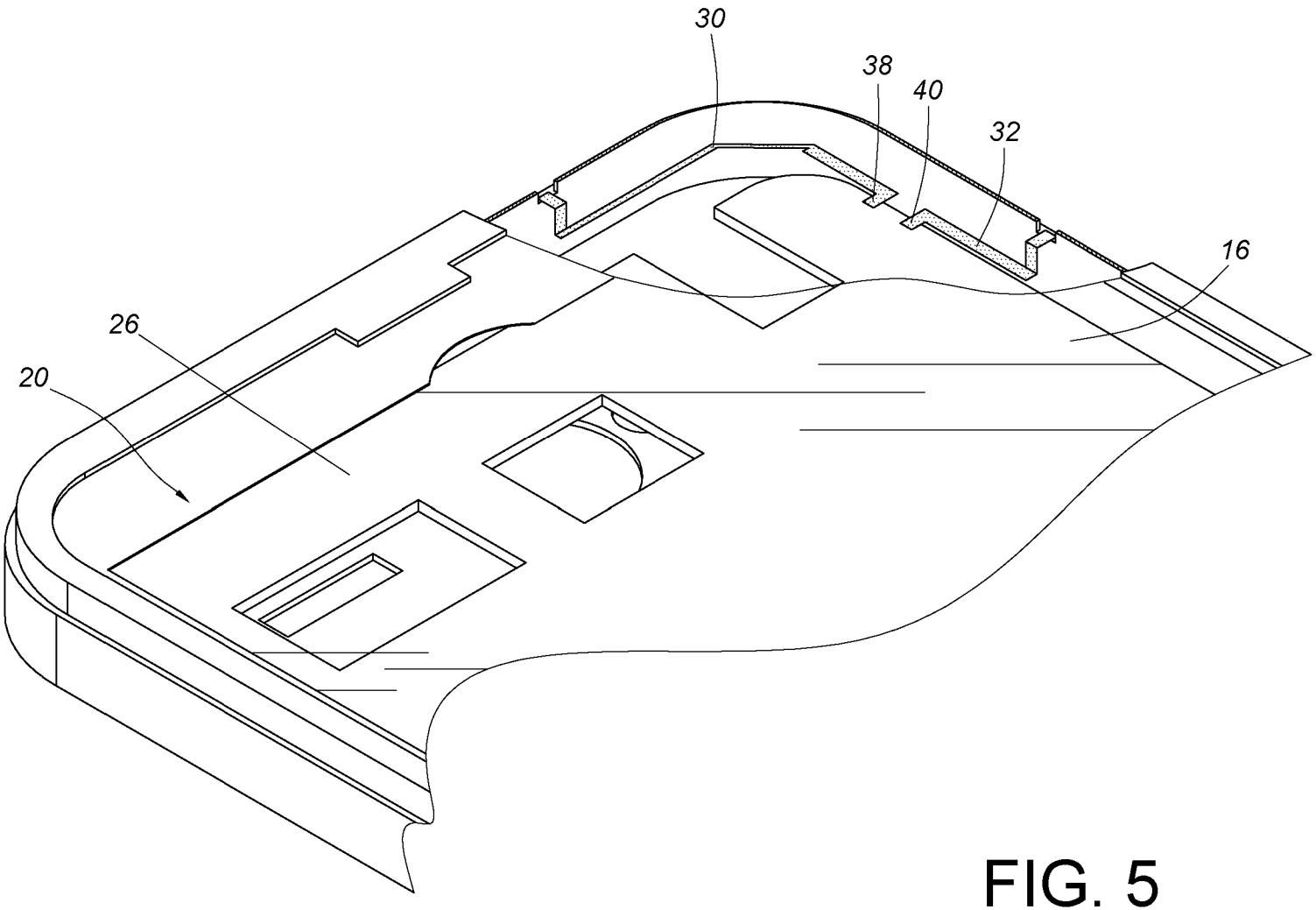
FIG. 5 is a diagram showing arrangement of the antenna at the first position of the communication device (without showing a metal frame) according to the embodiment of the present.
Figure 6:
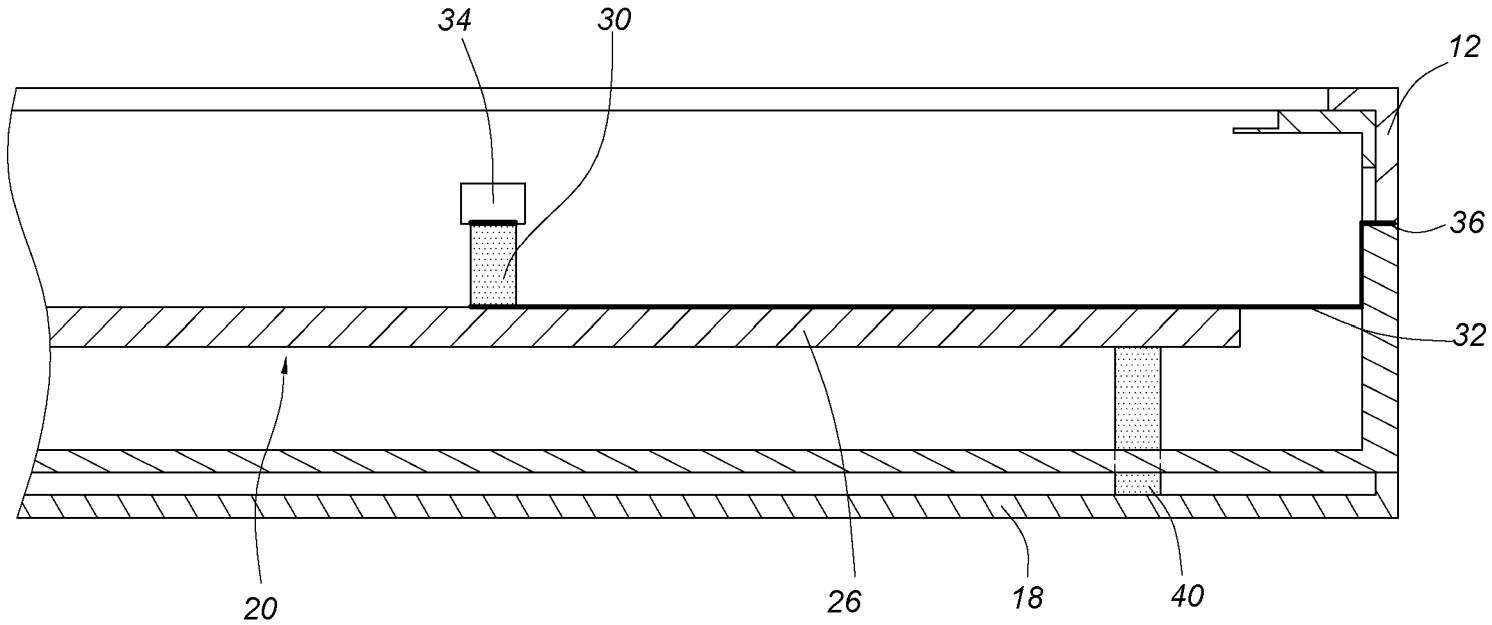
FIG. 6 is a diagram showing relationship between a metal back cover and a ground terminal of a first circuit block of a printed circuited board according to an embodiment of the present invention.
Figure 7:
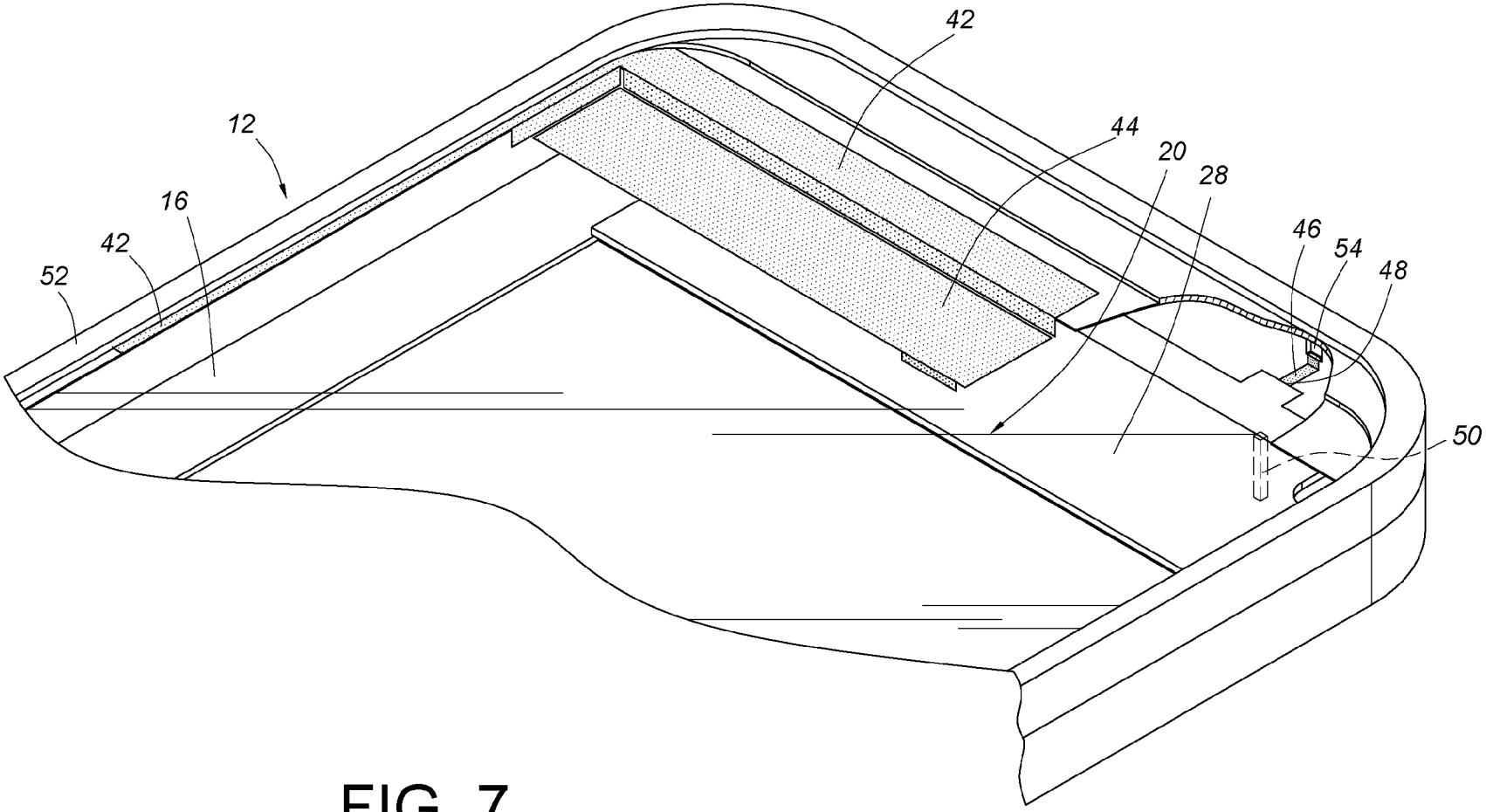
FIG. 7 is a diagram showing arrangement of the antenna at a second position of the communication device according to an embodiment of the present invention.
Figure 8:
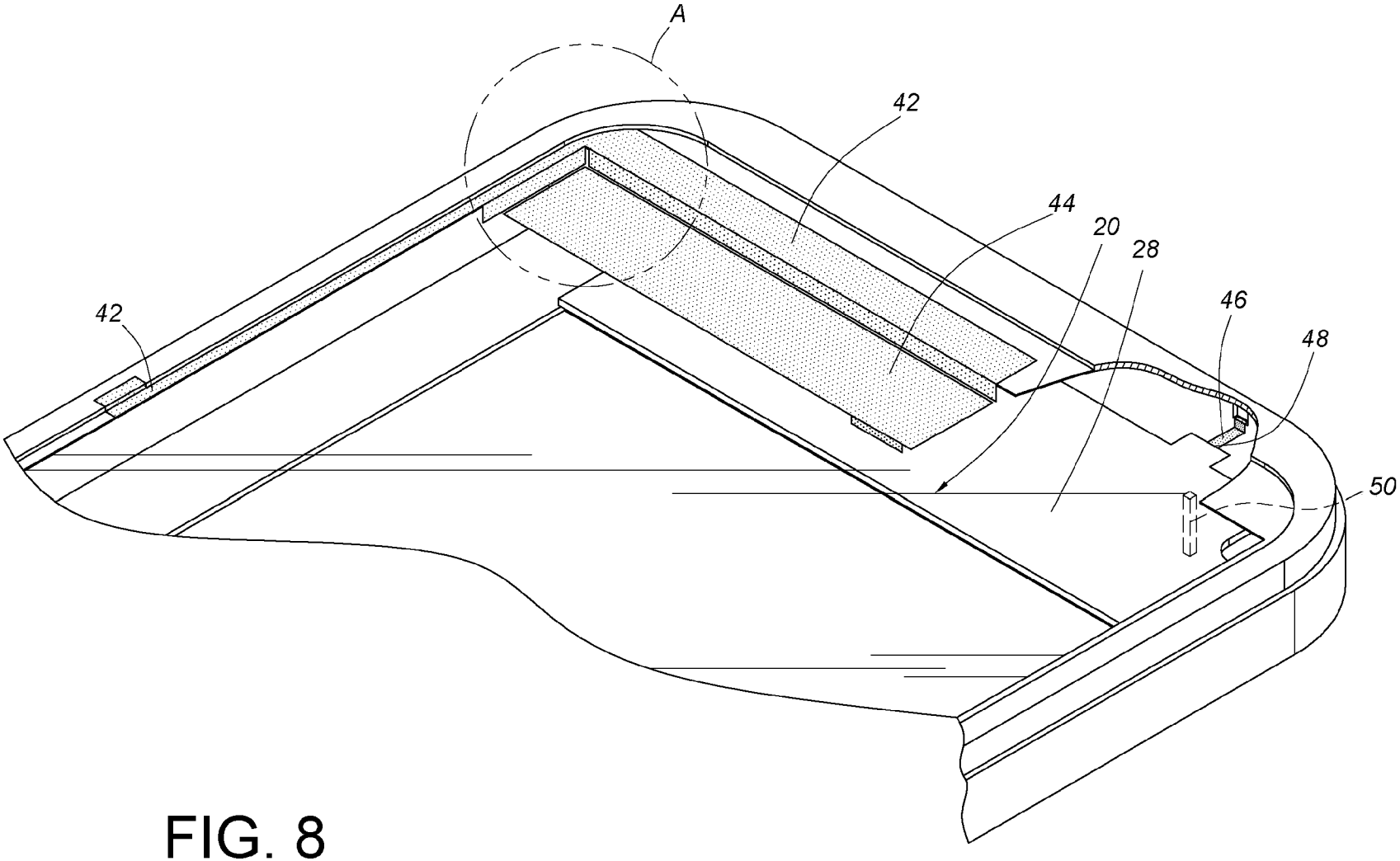
FIG. 8 is a diagram showing arrangement of the antenna at the second position of the communication device (without showing the metal frame) according to the embodiment of the present.
Figure 9:
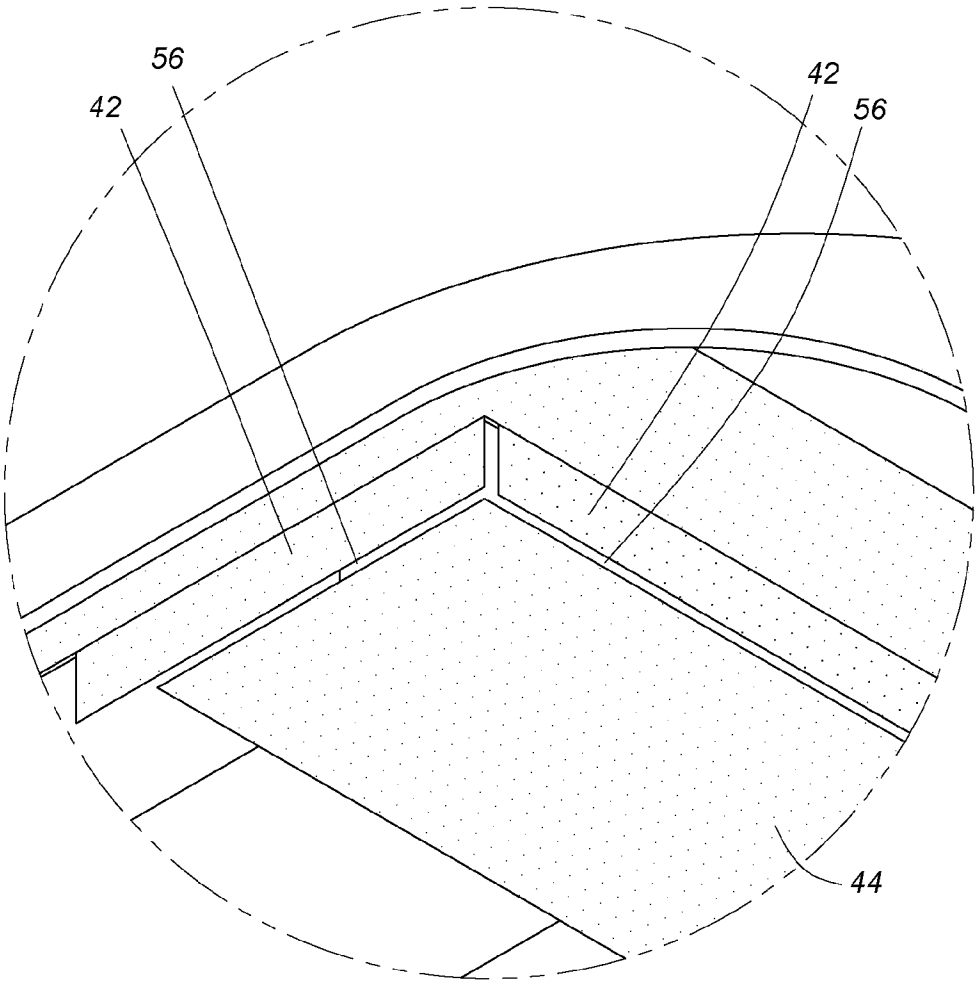
FIG. 9 is an enlarged view of an area A in FIG. 8.
Figure 10:
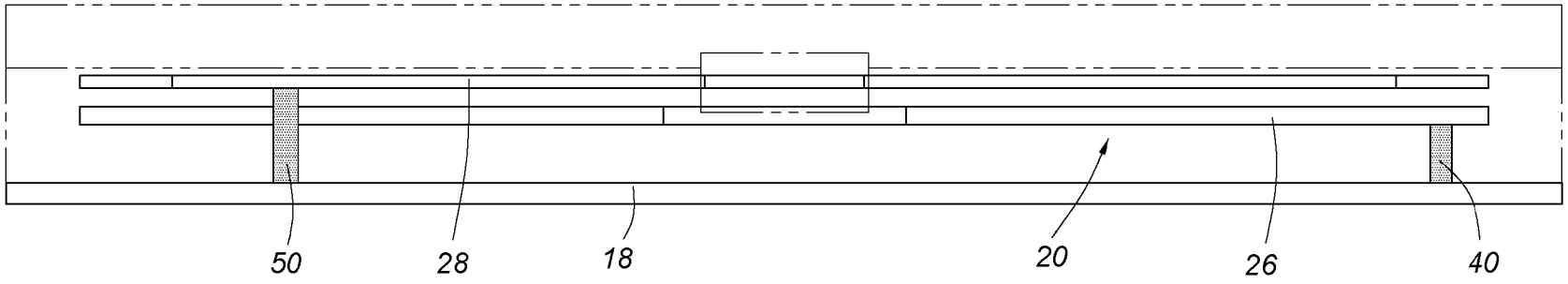
FIG. 10 is a diagram showing relationship between the metal back cover and round terminals of the printed circuited board according to an embodiment of the present invention.

FIG. 3 is a diagram showing arrangement of an antenna of the communication device according to an embodiment of the present invention. FIG. 4 to FIG. 6 are diagrams showing antenna arrangement of the communication device 10 supporting a first communication function, such as a global positioning system (GPS) function. The arrangement in FIG. 4 to FIG. 6 comprises the metal frame 12, the first circuit block 26 of the printed circuit board 20, a first conductor 30, a second conductor 32 and the metal back cover 18. The metal frame 12 has a first part 34 and a second part 36 located at a position different from a position of the first part 34. In a preferred embodiment, the first part 34 and the second part 36 of the metal frame 12 are located closely to an upper right position of the display panel 16. The first circuit block 26 of the printed circuit board 20 comprises a signal terminal 38 and a ground terminal 40. The first conductor 30 is connected between the first part 34 of the metal frame 12 and the signal terminal 38 of the first circuit block 26 of the print circuit board 20. The second conductor 32 is connected between the second part 36 of the metal frame 12 and the ground terminal 40 of the first circuit block 26 of the print circuit board 20 . When assembling the antenna, the metal back cover 18 contacts the ground terminal 40 of the first circuit block 26 of the printed circuit board 20.

FIG. 7 to FIG. 10 are diagrams showing antenna arrangement of the communication device 10 supporting a second communication function, such as a global system for mobile communication (GSM) function. The arrangement in FIG. 7 to FIG. 10 utilizes the metal frame 12 as a common antenna, wherein the arrangement comprises the second circuit block 28 of the printed circuit board 20, a third conductor 42, a fourth conductor 44 and a signal line 46. The second circuit block 28 of the printed circuit board 20 comprises a signal terminal 48 and a ground terminal 50. The metal frame 12 further has a third part 52 and a fourth part 54 located at a position different from a position of the third part 52. In a preferred embodiment, the third part 52 and the fourth part 54 of the metal frame 12 are located closely to a lower right position of the display panel 16. The third conductor 42 is connected to the third part 52 of the metal frame 12, and extended a length to be close to the second circuit block 28 of the printed circuit board 20. The fourth conductor 44 is connected to a ground surface of the second circuit block 28 of the print circuit board 20 for conducting to the ground terminal 50, and at least one coupling gap 56 is defined between the third conductor 42 and the fourth conductor 44. The signal terminal 48 of the second circuit block 28 of the printed circuit board 20 is electrically connected to the fourth part 54 of the metal frame 12. In an embodiment, the signal terminal 48 of the second circuit block 28 of the printed circuit board 20 can be electrically connected to the fourth part 54 of the metal frame 12 through the signal line 46 connecting or contacting the fourth part 54 of the metal frame 12; or, in another embodiment, the signal terminal 48 of the second circuit block 28 of the printed circuit board 20 can directly connect or contact the fourth part 54 of the metal frame 12, the present invention is not limited to the above. When assembling the antenna, the metal back cover 18 contacts the ground terminal 50 of the second circuit block 28 of the printed circuit board 20.

According to the above arrangement, when the communication device 10 is powered by an external power source, such as a battery, the metal frame 12 can work as a common antenna for the first communication function (GPS) and the second communication function (GSM). The antenna forms an approximate large loop antenna to cooperate with the first conductor 30 and the second conductor 32 forming a small loop antenna smaller than the metal frame 12, in order to provide required communication capability to the communication device 10 through calculation processing of the printed circuit board 20. On the other hand, the third conductor 42 and the fourth conductor 44 are pre-arranged to form an open circuit state through the at least one coupling gap 56, so as to adjust required antenna matching, such as impedance matching, according to requirement. The signal terminal 48 of the second circuit block 28 of the printed circuit board 20 is coupled to the ground surface and the ground terminal 50 of the second circuit block 28 of the printed circuit board 20 for grounding through the at least one coupling gap 56, and the ground terminal 50 contacts the metal back cover after assembling.

According to the above illustration, the advantages of the present invention is that appearances of the metal back cover and the metal frame are not ruined by design of the antenna, and the present invention can have better appearance in contrast to the prior art, so as to allow the communication device to have great diversity of design.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A communication device, comprising:

a metal frame defining an opening, the metal frame having a first part, a second part located at a position different from a position of the first part, a third part, and a fourth part located at a position different from a position of the third part;

a display module;

a display panel installed between the display module and the metal frame, and corresponding to the opening of the metal frame;

a metal back cover;

a printed circuit board, comprising a first circuit block and a second circuit block electrically connected to the first circuit block, each of the first and second circuit blocks comprising a signal terminal and a ground terminal, wherein the ground terminal contacts the metal back cover;

a main body located between the metal frame and the metal back cover, the main body being made of a non-conductive material;

a first conductor connected between the first part of the metal frame and the signal terminal of the first circuit block of the print circuit board;

a second conductor connected between the second part of the metal frame and the ground terminal of the first circuit block of the print circuit board;

a third conductor connected to the third part of the metal frame; and a fourth conductor connected to the ground terminal of the second circuit block of the print circuit board, at least one coupling gap being defined between the third conductor and the fourth conductor;

wherein the signal terminal of the second circuit block of the printed circuit board is electrically connected to the fourth part of the metal frame.

2. The communication device of claim 1, wherein the first part and the second part of the metal frame are located closely to an upper right position of the display panel.

3. The communication device of claim 1, wherein the third part and the fourth part of the metal frame are located closely to a lower right position of the display panel.

4. An antenna of a communication device, comprising:

a metal frame having a first part, a second part, a third part, and a fourth part;

a metal back cover;

a printed circuit board, comprising a first circuit block and a second circuit block electrically connected to the first circuit block, each of the first and second circuit blocks comprising a signal terminal and a ground terminal, wherein the ground terminal contacts the metal back cover;

a first conductor connected between the first part of the metal frame and the signal terminal of the first circuit block of the print circuit board;

a second conductor connected between the second part of the metal frame and the ground terminal of the first circuit block of the print circuit board;

a third conductor connected to the third part of the metal frame; and a fourth conductor connected to the ground terminal of the second circuit block of the print circuit board, at least one coupling gap being defined between the third conductor and the fourth conductor;

wherein the signal terminal of the second circuit block of the printed circuit board is electrically connected to the fourth part of the metal frame, and is coupled to the ground terminal of the second circuit block of the printed circuit board through the at least one coupling gap.

5. The antenna of the communication device of claim 4, wherein the third conductor is extended a length to be close to the second circuit block of the printed circuit board.

* * * * *